United States Patent [19]

Drebinger

[11] 4,303,905

[45] Dec. 1, 1981

[54] METHOD AND APPARATUS FOR CALCULATING THE GREEN LIGHT TIME IN TRAFFIC-DEPENDENTLY CONTROLLABLE STREET TRAFFIC SIGNAL SYSTEMS

[75] Inventor: Peter Drebinger, Munich, Fed. Rep. of Germany

[73] Assignee: Siemens Aktiengesellschaft, Berlin & Munich, Fed. Rep. of Germany

[21] Appl. No.: 938,410

[22] Filed: Aug. 31, 1978

[30] Foreign Application Priority Data

Sep. 5, 1977 [DE] Fed. Rep. of Germany ..... 2739863

[51] Int. Cl.[3] ..... G08G 1/08

[52] U.S. Cl. ..... 340/41 R; 340/31 A; 340/37; 340/38 R; 364/437

[58] Field of Search ..... 340/31 A, 41 R, 37, 340/38 R, 31 R, 46, 43; 364/436, 437, 438; 235/92 TC

[56] References Cited

U.S. PATENT DOCUMENTS

| | | | |
|---|---|---|---|
| 3,241,109 | 3/1966 | Du Vivier | 340/37 |
| 3,466,599 | 9/1969 | Clark | 340/37 |
| 3,833,881 | 9/1974 | Drebinger et al. | 340/31 A |

*Primary Examiner*—James J. Groody

*Attorney, Agent, or Firm*—Hill, Van Santen, Steadman, Chiara & Simpson

[57] ABSTRACT

A traffic-dependently controllable signaling system utilizing the lengths of the time intervals between two successive vehicles for terminating the green light duration for the involved flow of traffic, in which each time interval is compared with a first, larger theoretical time limit value. If the first theoretical time limit value is reached, the green light signal for such traffic flow is terminated. In addition, all time gaps are compared with a second smaller theoretical time limit value and if this second theoretical time limit value is exceeded by two successive time intervals or at least two of a group of time intervals, the green light signal for the particular flow of traffic is likewise terminated.

8 Claims, 7 Drawing Figures

D1
FZB1
GN1
FE1
D2
FZB2
GN2
FE2
D6
FZB6
GN6
FE6
Traffic Time Components
T1
FUB1
T2
FUB2
GN21
GN22
Pedestrian Comps.
EAN
ZWAN
FE1 FE2 FE6
AN23
OR4
GN6
GN2
GN1
AN24
UEB
OR3
FAN1
FAN2
FAN6
PF
FUN1
FUN2
EAN1
ZWAN
Programming Field
LPT1
APT1
LPT2
APT2
LPT3
APT3
LPT18
APT18
K1
K2
K3
K18
AN1
AN2
AN3
AN18
OR2
OR1
FF
UEB
AN21
AN22
PTS
SRV
ST
Configuration Distributor
RS
1 2 3 4 5 60
MGV RS KO EP1 2 3 4 5 60 MPW MPT1 2 3 18

METHOD AND APPARATUS FOR CALCULATING THE GREEN LIGHT TIME IN TRAFFIC-DEPENDENTLY CONTROLLABLE STREET TRAFFIC SIGNAL SYSTEMS

BACKGROUND OF THE INVENTION

The invention relates to a method and apparatus for calculating the green light duration in traffic-dependently controllable street traffic signal systems utilizing time intervals.

In accordance with the prior art, it is known to utilize time intervals to calculate the green light time interval between two vehicles following one another, utilizing vehicle detectors, and to compare the results with a theoretical time-limiting value. If this theoretical time-limiting value is exceeded, a switching order is issued to the traffic signal control system to terminate the green light duration. Some motorists, however, maintain an unnecessarily large distance behind the car ahead, and thus conventional systems, in spite of a normal flow of traffic, result in green light period being prematurely terminated even though a large number of vehicles may still be approaching an intersection. Working within the confines of adjustable parameters in prior art systems, this problem could be counteracted only by an impermissible long time interval whereby the disconnection of the green light period no longer could be regulated with a suitable degree of sensitivity.

BRIEF SUMMARY OF THE INVENTION

The invention is directed to a solution eliminating the above-mentioned disadvantages of conventional traffic regulation systems, that is, the utilization of a permissibly short time interval in a system which still achieves a relatively sensitive discontinuance of the green light period.

According to the invention, this is accomplished by a method utilizing the following method steps:

(a) Recording the time intervals between successive vehicles occuring during a green light signal at the associated intersection;

(b) Comparison of each time interval with a first time-limiting theoretical value, and disconnecting the green light signal when this first time-limiting theoretical value has been reached; and (c) Comparison of at least two successive time intervals with a second time-limiting theoretical value and termination of the green light signal upon the exceeding of such second time-limiting theoretical value by both actual values.

It is particularly advantageous to compare a greater number than two successive time intervals with the second time-limiting theoretical value, and to terminate the green signal upon agreement of at least two of such actual values with the second time-limiting theoretical value. One embodiment of the invention comprises an installation employing such method, in which memory and comparison systems compare a predetermined number of time intervals, processable by detectors, with the first and second time-limiting theoretical values and immediately terminate the green light over OR gates after the first time-limiting theoretical value has been reached, or upon the attainment in several cooperable memories of the second time-limiting theoretical value, issue the termination order over AND and OR gates. By dimensioning the green light period in accordance with this time interval sequence, the objective is achieved that as many vehicles as possible can cross the intersection per unit of time.

With heavy traffic, traffic backups occur at all approach roads to an intersection, which as a rule extends beyond the vehicle detectors located in area of the access road. Assuming a distance of about 10 to 40 meters of such vehicle detectors from the stop line, approximately two to seven passenger cars are at an average spacing, in the stopping range of 6 meters between vehicle detector and stop line. Consequently, no indication can be obtained from the vehicle detector at the start of the green light concerning backup length, traffic congestion or traffic volume. However, as a result of the cluster formation, created by motorists' typical behavior, a favorable calculation of the green light nevertheless is possible. In fact, each group of vehicles forms at the detector during heavy traffic, i.e. at high traffic density, short time intervals with pronounced frequency. In this respect it is relatively immaterial whether the traffic flows freely or perhaps moves very slowly, possibly due to vehicles making left turns. At the end of the group of vehicles longer time gaps occur, i.e. the traffic stretches out. Generally, it may be stated that with light traffic the frequency of short time intervals decreases and the number of longer time intervals increases.

However, because only time intervals, and not time of occupancy are evaluated, no particular requirements are imposed on the vehicle detector loops as to position and length thereof, in contrast to "time interval-occupied time calculation". In accordance with the method of the invention, only a single vehicle detector loop is necessary to control several driving lanes. Moreover, the vehicle detector time interval, which is an exclusive measured variable, is more useful in the evaluation of time interval sequence for the traffic engineer than a measuring system jointly evaluating time intervals and busy periods.

BRIEF DESCRIPTION OF THE DRAWINGS

In the drawings wherein like reference characters indicate like or corresponding parts.

DETAILED DESCRIPTION OF EXEMPLARY EMBODIMENT

Figure 1:
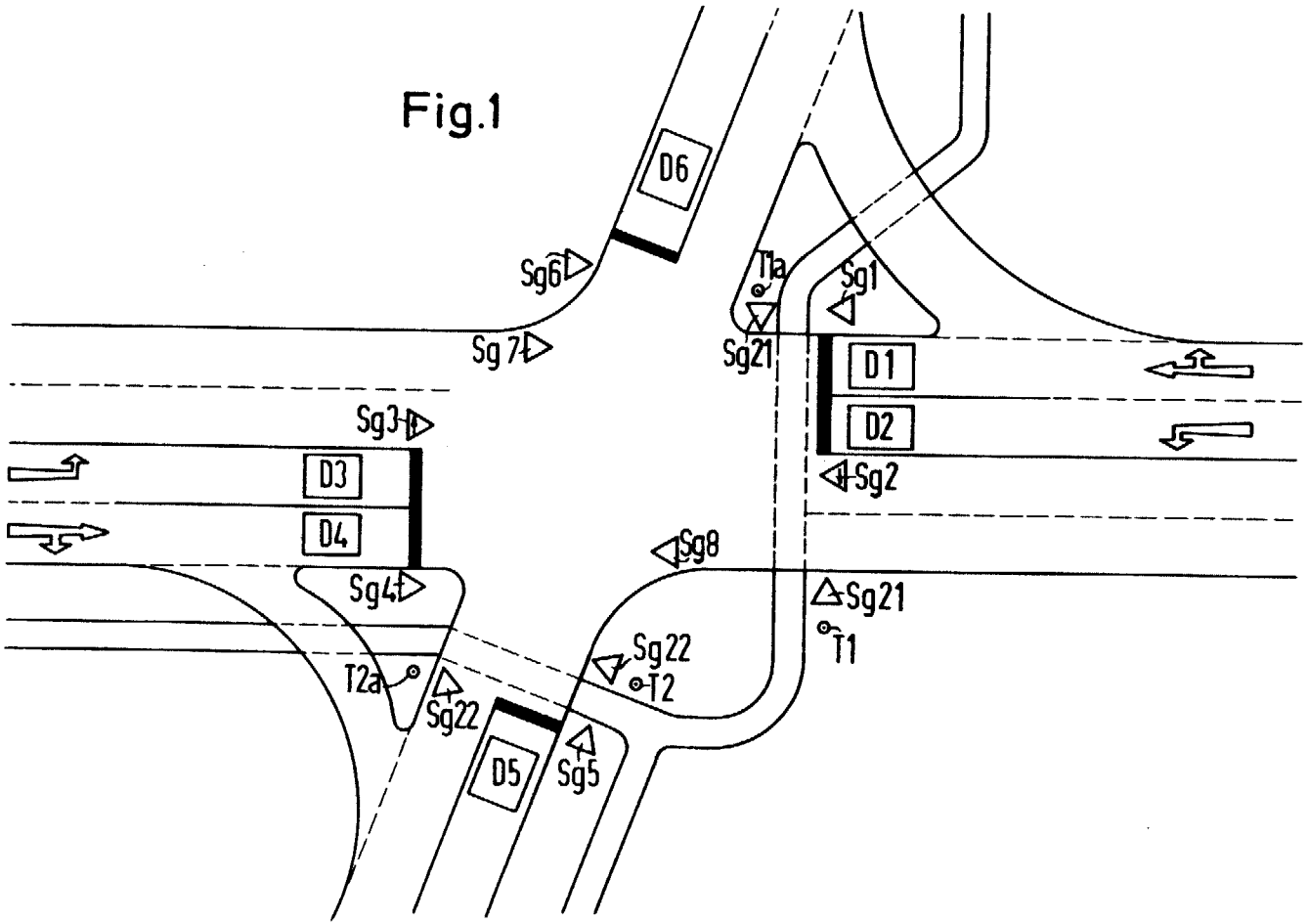
FIG. 1 is a street plan of an intersection controlled by a device in accordance with the present invention.

Referring to FIG. 1, there is illustrated the map of a street intersection, utilized as an exemplary intersection for the purposes of explanation of the present invention. Vehicle traffic is monitored by detector loops D1 through D6, and manual pressure switches or the like T1, T1a, T2 and T2a which are provided for pedestrian use. The traffic flows are controlled by the various signal generators or lights Sg1 through Sg8 and the pedestrian signal lights or generators Sg21 and Sg22, with the signal generators Sg7 and Sg8 being diagonally disposed generators which, for example, may exhibit a yellow signal or arrow for left turns.

Figure 2:
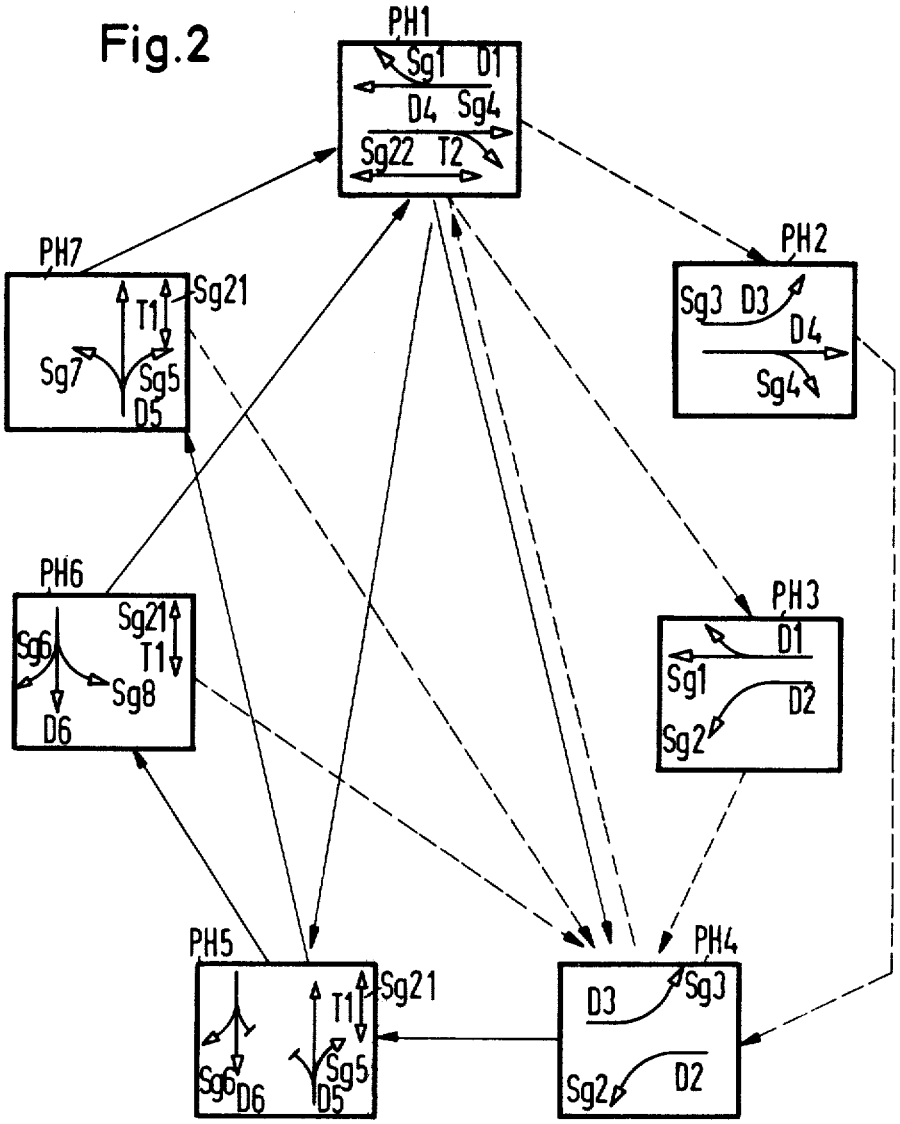
FIG. 2 represents a block chart illustrating the possible successions involved in the illustrative embodiment.

FIG. 2 illustrates respective phase diagrams for the phases 1 through 7 as they may be determined for a particular intersection, in this case, for the intersection illustrated in FIG. 1. The respective traffic configuration of each phase illustrates both traffic flows receiving a release or "go" signal in the respective signal section, whereby each flow is designated by the respective detectors and signal generators. The seven phase configurations, however, are not switched on in a fixed succession, one after the other, but, in dependence upon the traffic conditions, one of the two or more alternate phase configurations is selected, with various phases being passed over completely. For example, the phases PH6 and PH7 are partial phases of phase PH5 wherein a previously restricted left turn traffic of one traffic direction of phase 5 receives a "go" signal. The determination as to which partial phase follows phase 5 depends on the demands of the detectors D5 and D6, respectively, during the running of phase PH5. A program part is associated with each of the shown phase configurations in the fixed memory of the control device in which the possible phase positions are also stored in the form of program parts. The total number of possible program parts is determined by the size of the device or memory respectively. In the case of a four-phased intersection with a non-cyclic phase succession 4. $(4-1)=12$ phase transitions are conceivable. For programming, 16 program parts would thus be required. However, because usually it is not required in practice to employ all conceivable phase transitions, the number of program parts required is reduced, so that additional phases and phase transitions can be programmed with the remaining program parts. The number of phases thus is not limited to four in the present case.

For the present explanation a 5-phase intersection with two partial phases is disclosed, so that in all 7 phases PH1 through PH7 are utilized. The desired phase changes are illustrated in FIG. 2 with phase succession being illustrated by solid lines in accordance with vehicle and pedestrian demands. Transition from phase PH5 to PH6 or PH7, depends on the demands determined by the detector loops D5 and D6, respectively, while the dotted lines of FIG. 2 illustrate phases which may be skipped during a sequence of operation in the absence of a detected demand therefor.

As will be apparent from FIG. 2, from a practical standpoint, not all theoretically possible phase transitions are required, nor is it necessary to represent each phase transition by a respective program part. For example, the change to phase PH6 or PH7, respectively, is possible only from phase PH5, as a result of which the transition-signal configurations may be disposed in the program part of phase PH6 or PH7, respectively. Likewise, phases PH2 and PH3 may follow only after PH1. Consequently, the transitions PH1-PH2 or PH1-PH3, respectively, can also be programmed in the program part of phase PH2 or PH3, respectively. After phase PH2 or PH3 only phase PH4 can be actuated and consequently only the transitions PH2-PH4 or PH3-PH4, respectively, are required and transitions from phase PH2 or phase PH3 are not required in the other phases. As a result of traffic-technical consideration, only the required phases and phase transitions are programmed for each intersection, so that the memory capacity can be at an optimum.

The construction and manner of operation of a signal-control device in accordance with the invention will be explained in connection with the block diagram of FIGS. 3*a* and 3*b* in which the detector loops D1 through D6 and pedestrian keys T1 and T2 form the means for deriving traffic-flow control data as previously explained in connection with FIG. 1. The respective detector loops D1 to D6 are operatively connected with respective traffic time components FZB1 through FZB6, wherein the signals from the associated detectors are evaluated in known manner in accordance with the prior art.

In requesting release or "go" signals for the respective traffic flow, the vehicle time components FZB are operative to emit a vehicle request signal FAN1 through FAN6 which are supplied to the programming field PF. Such a request signal, for example, might be formed in a simple manner by the storage of a detector signal. However, it is also possible to produce different request signals representative of the number of vehicles, speed thereof, as well as other criteria, which are not the subject of the present application. In a similar manner, as explained with respect to the vehicle detectors, pedestrian request signals FUN1 and FUN 2 may be supplied to the programming field in the event of the actuation of one of the pedestrian keys T1 or T2, over the pedestrian components FUB1 or FUB2, respectively.

The programming field PF, the construction of which is explained in greater detail in connection with FIG. 5, contains logical components by means of which logical linkings can be effected between the input-side request signals FAN and FUN, the signal of the currently running program part LPT1 . . . 18, as well as possible additional superior order signals EAN or initial request signals ZWAN. In response to the respective existing conditions, one of the program parts stored in the device is thus requested, as a result of which a corresponding request signal APT1 . . . 18 will appear at the output distributor of the program field, which will thereby insert the respective program part into the cycle.

When the program conditions for the selection of a requested program part, for example APT3, are fulfilled, a signal will appear at the output APT3 of PF and will result in the program part APT3 being switched on and becoming the running program LPT3. The signals APT1 . . . 18 are conducted to an AND member AN21, over an OR member OR1, and as soon as the respective signals MPW for the program-part change is received from the memory SRP, the flipflop member FF is flipped and will produce a passover signal UEB which causes the configuration distributor SRV to rapidly pass over non-requested program parts, thus omitting such non-requested program parts.

Figure 3A:
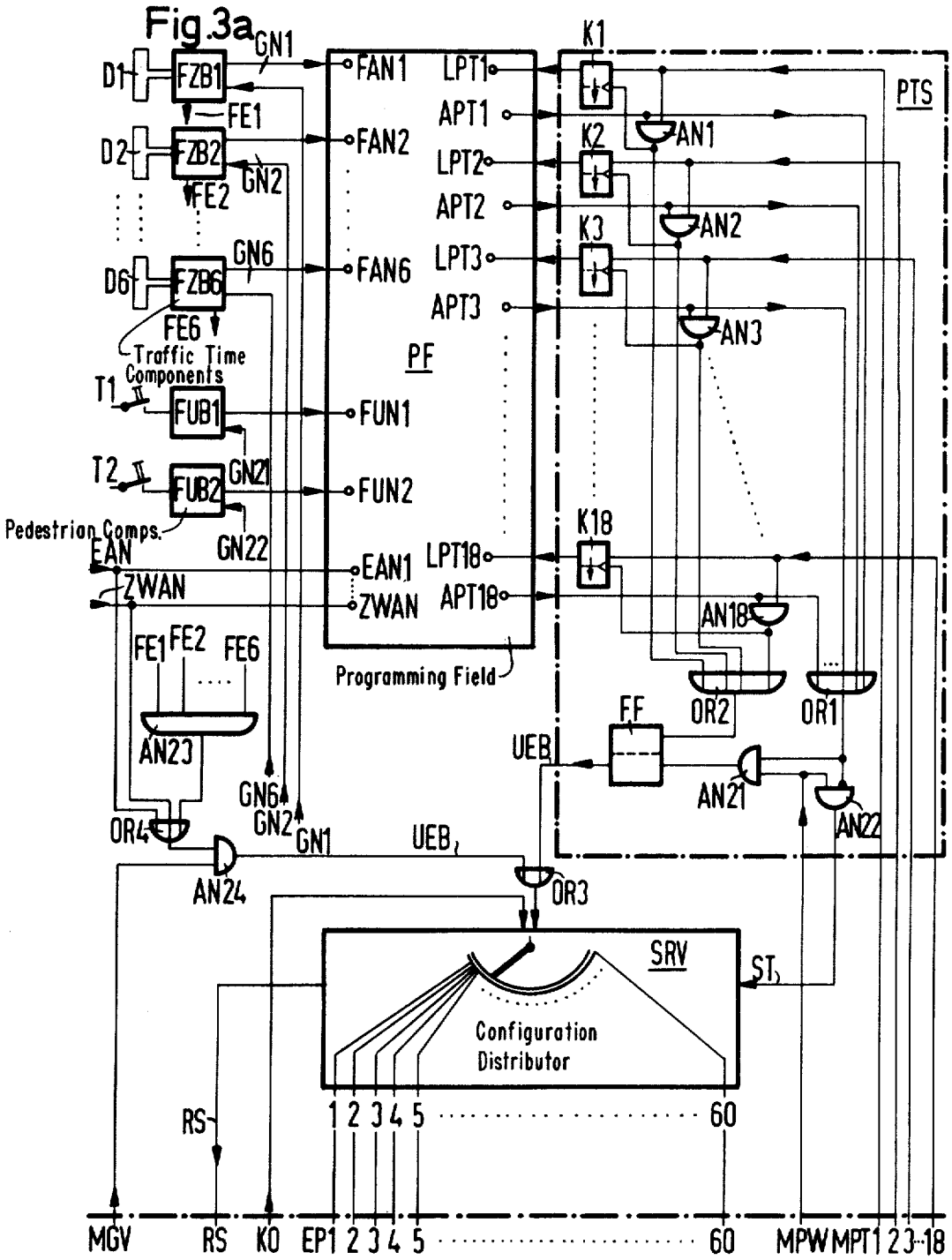
FIGS. 3*a* and 3*b*, taken together, represent a circuit diagram, in block form, of a control system involved in the illustrated embodiment.
Figure 3B:
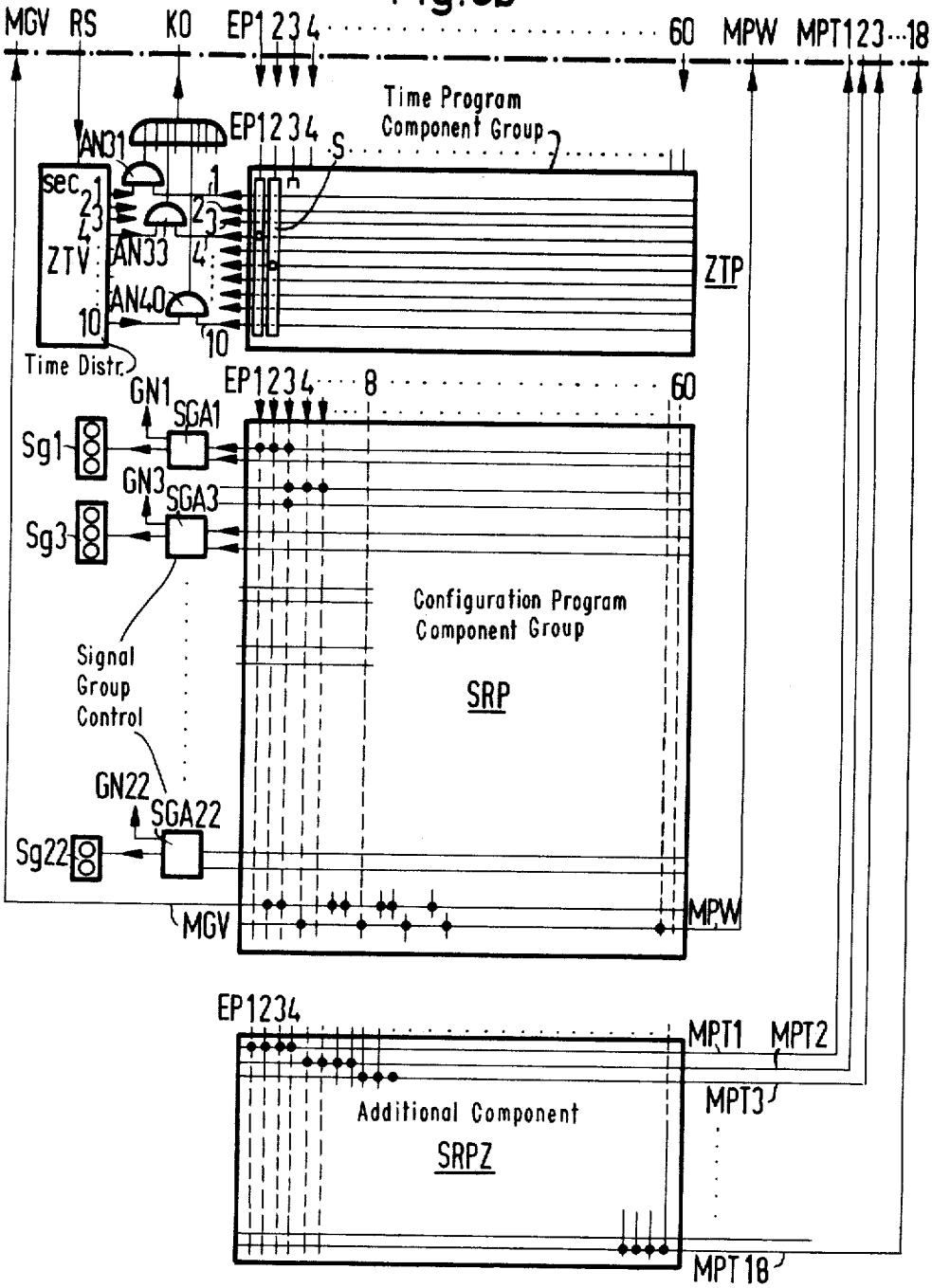

The program-part control PTS receives output signals MPT1 . . . 18 from the memory referenced at SRPz in FIG. 3*b*, which has inputs EP1 . . . 60 respectively connected to the outputs 1 . . . 60 of the distributor SRV, with the outputs MPT1 . . . 18 indicating the specific program part being triggered by the distributor SRV. Upon the distributor SRV, after passover of non-requested parts, reaching a requested program part, a signal will appear at the respective input MPT of the program-part control PTS, and AND member, for example AN3 is triggered in the program-part control PTS and, over the OR member OR2, will cause the flip-flop FF to flip back, thereby cancelling the passover order UEB, which will thereupon disappear at the distributor SRV. The triggered program part thus is processed with the desired program time.

Simultaneously, one of the flipflop members K1 . . . 18 is set for the purpose of using the currently running program part LPT in the programming field PF, for the requesting or blocking of further MPT signals. Thus, in accordance with the example above referred to, the flipflop member K3 is set and will produce the signal LPT3 as long as the program part PT3 is switched on. Upon the absence of the signal MPT3 the flipflop member K3 will reset and the signal LPT3 will disappear in the programming field PF.

The signal configuration of all program parts are programmed in the fixed memory, which basically consists of the time program component ZTP, the configuration program component SRP and an additional memory component SRPZ (FIG. 3*b*). All three component groups in the present example have 60 inputs EP1 . . . 60, which can be addressed by the configuration distributor SRV. The 60 inputs are associated with the 18 program parts in a selected program succession so that each program has several inputs at which a signal may occur to begin the program.

A predetermined time from 1 to 10 seconds can be programmed for each input to a conductor plate ZTP with the conductor plate being provided with 60 inputs which respectively can be connected with any one of the ten outputs by means of a corresponding slide switch S, whereby the time programming for each input can be selectively changed, in a very simple manner. Each time a signal appears at an input EP1 . . . 60 as a result of the output of the distributor SRV respresenting a starting point for the associated program part. The time distributor ZTV is simultaneously reset to zero seconds by a reset signal RS, so that it then begins to count from one second through 10, and as soon as the programmed second is reached at the respective input EP involved, the signal KO will be supplied over AND members AN31 . . . 40 which, following the expiration of such second, will further switch the structure distributor SRV to the following starting point EP and will reset the time distributor ZTV, over the signal line RS, to zero seconds, and the processing of the following input will begin. If, however, the signal MPW is supplied to the distributor SRV, denoting the last starting point of the running program part, a further switching of the distributor will only be effected with the passover signal UEB.

The configuration program component SRP is constructed in the form of a conductor plate, upon one side of which 60 conductor paths are arranged corresponding to the 60 starting points which, in correspondence to the time program component ZTP, can be parallelly connected to the configuration distributor SRP. On the other side of the conductor plate, conductor paths are also provided extending at right angles to the first mentioned conductor paths, whose number depends on the number of signal groups with each signal group being associated with two conductor paths forming programming tracks. In addition, the component groups will carry further programming for the control signals and, for example, for marking the respective program part (MPW) or for making starting points with variable green time (MGV). A bore at each cross point of the matrix, represented by the shaded circles in FIG. 3*b*, permits the operative connection of a starting point conductor path with one or both programming tracks of a signal group by means of a connecting diode screw.

Upon triggering of such starting point by an appropriate input to the configuration distributor SRV, the corresponding signal-group control SGA1 . . . 22 is triggered over the corresponding programming diode screw and the programming track, with the programmed signal thus being produced for such signal group. In this manner, the desired signal configuration is selected at each starting point in accordance with the programming of the respective signal groups. It will be appreciated that as each signal group, as previously mentioned, is associated with two programming tracks so that it is possible, for example, to produce a GREEN signal by way of one programming track and a YELLOW signal by programming of the other track. If no programming diode screw is present, a RED signal will occur. However, if a programming diode screw is set upon both programming tracks of a single group a first signal state is selected whose signal-group configuration must first be fixed by a further programming upon the signal-group control SGA associated with the signal group. For example, the signal group configuration RED/YELLOW, GREEN/YELLOW or GREEN with simultaneous YELLOW blinking can be produced. The component groups SGA1 through SGA22 will also provide the impulses for the lamp switches of the respective signal generators Sg1 through Sg22 to effect the illumination thereof.

It will also be noted that the signal group controls SGA1 through SGA6 are also connected with the respective associated vehicle components FZB1 through FZB6, whereby the signal GN1 . . . 6 indicates to the associated vehicle component FZB that the respective signal group has a GREEN signal. During this time period, for example, no vehicle request signal FAN is formed. Such GREEN signal GN1 . . . 6 can also be employed for effecting a GREEN-time measurement which is known per se, during the GREEN phase of a signal group.

For this situation, the programming track MGV (marking GREEN time variable) is provided in the configuration component SRP. Thus, all inputs upon this track are marked which, if necessary or desired, are not to be run with the programmed input time but which, in dependence upon the traffic condition, may be passed over at the end of the respective GREEN time, namely within a running program part. In order to effect a premature switching or a passover of such a starting point, a vehicle end signal FE1 . . . 6 must be given from each vehicle time component FZB whose signal group shows GREEN. Each vehicle time component FZB supplies a signal FE1 . . . 6 to the AND member AN23, which signal FE is always positive when no GREEN-time measurement is effected, i.e. when either no GREEN signal is given at the respective signal group, or when the GREEN-time measurement is already supplied. Only when a GREEN-time measurement is effected in one or in several components FZB, is the AND member AN 23 blocked.

However, if the GREEN-time measurement of all time components FZB is finished, coincidence will be achieved at the AND member AN 23 and a signal will be supplied to the AND member AN 24 over the OR member OR4. If the respective input has a connection to the input MGV for variable GREEN time, this signal appears at the second input of the member AN 24 and will, over the OR member OR3, supply a passover signal UEB to the distributor SRV. If further inputs follow the marking MGV, these will also be passed over. An external mannual request signal EAN or a compulsory request signal ZWAN also effect, over the OR member OR 4, a passover of starting variable GREEN time.

In accordance with the present example, the last input of each program part is respectively provided with a connection to a marking MPW which produces the passover signal UEB in the part cntrol PTS, if a new program part APT is requested. If several program parts are requested, they will be processed in the programmed succession of the inputs EP. However, if the end of a program part with the marking of MPW is reached, and no new program part is requested, a stop signal ST is produced over the AND member AN22 which stops the distributor SRV, so that it does not continue to the next starting point. As a result, the last program part to be switched on will remain until a new program part is requested.

The additional memory SRPZ is operative to indicate the respective running program part in the program-parts control PTS by means of one of the marking lines MPT1 . . . 18. The component SRPZ likewise is constructed in the form of a matrix-conductor plate, in which the respective partial program track MPT is connected with all starting points of the associated program part.

Figure 4:
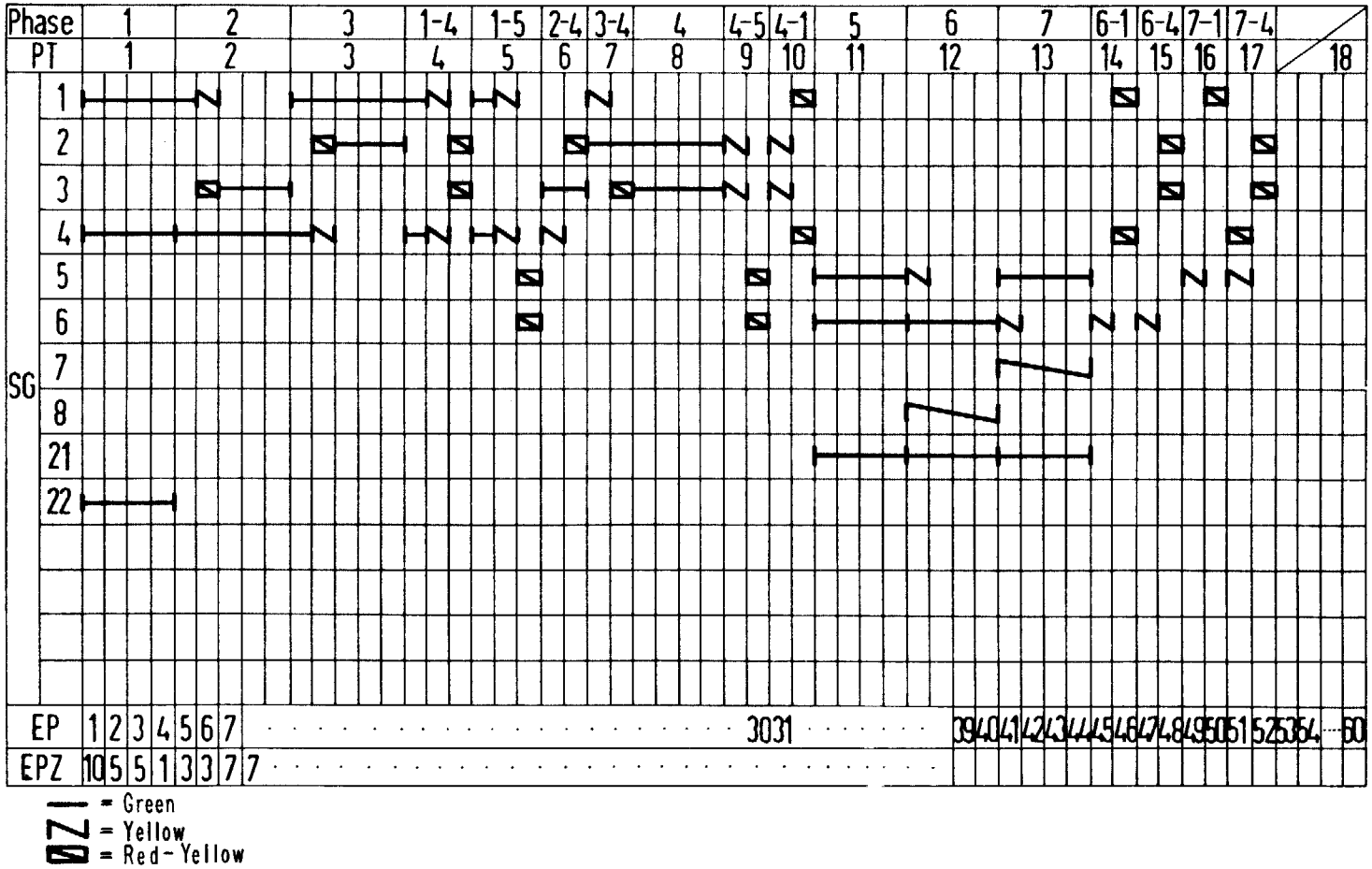
FIG. 4 is a program chart for the illustrated system.

FIG. 4 illustrates the relationship between the individual phases and the phase transitions with the program parts stored in the memory SRP and ZTP, in a specific program plan. In accordance with FIG. 2, seven phases are supposed to be capable of being switched with 14 phase transitions, as shown. As previously mentioned, the transitions 1-2, 1-3, 5-6 and 5-7 may be programmed in the program parts associated with the phases 2, 3, 6 and 7, so that only 10 program parts are required for the respective phase transitions. Taken with the seven phases, 17 program parts are to be stored so that one of the possible 18 program parts will remain available. In FIG. 4, the individual phases or transitions, are denoted in the first line with the associated program parts 1 through 17 being indicated in the second line. Each program part is associated with a certain number of inputs EP, with each column in the chart representing an input.

Within the program parts, the desired signal is determined for each signal group Sg1 . . . 8, 21 and 22, upon the configuration program SRP, and as previously mentioned, two programming tracks are available for each signal group so that four signal states, if required or desired, can be programmed.

Figure 5:
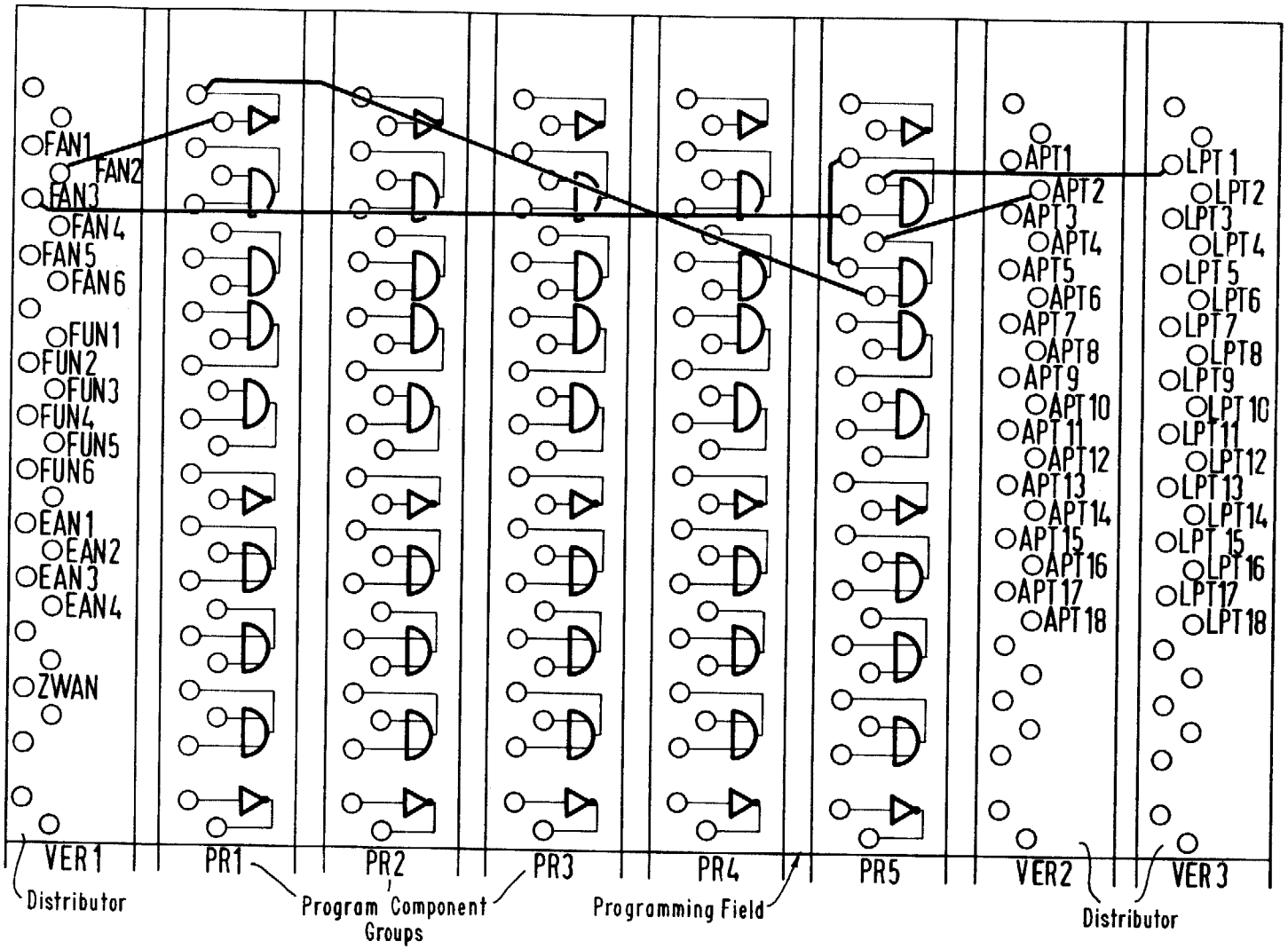
FIG. 5 is a detailed schematic representation of the programming field generally illustrated in FIG. 3*a*.

FIG. 5 illustrates, in greater detail, the construction of a programming field PF, which field is operable to convert the traffic-related signal demands, for example from the pedestrian keys T1, 2 or detector loops D1 . . . 6, into requests for stored program parts, by way of logical linking. Basically, the programming field PF comprises program component groups PR1 through PR5 and three distributors VER1 to VER3. Release signal demands are conducted to the input distributor VER1, i.e. vehicle requests FAN1 through FAN6 and pedestrian requests signals FUN1 through FUN6. Also, additional distributor points with respect to external requests EAN1 through EAN4 may be operatively connected, for example for effecting a manual operation or a central control operation. A compulsory demand ZWAN is also provided for conditions in which a particular signal configuration becomes of greater importance than the other signal configurations, for example for rail traffic or fire truck traffic, etc.

The programming component groups PR1 through PR5 carry AND or OR gates and inverters, by means of which the various request signals can be linked with the running parts, whereby new program parts can be requested in the most advantageous manner. The presently or currently running parts are, for this reason, processed to the individual distributor points LPT1 to LPT18 of the distributor VER3. The requested program parts, which are obtained from the logical linkages will finally appear at the distributor VER2 as signals APT1 through APT18. There is also the possibility within the distributors VER2 and VER3 to provide three additional distributor points for use with additional signals and additional programming.

As previously mentioned, the requests for the individual program parts are effected by way of logical linking of the vehicle or pedestrain requests and, for this reason, the conditions are initially fixed under which the individual program parts are to be requested. It can, for example, be determined from the intersection map of FIG. 1 and the phase configurations of FIG. 2 that the phase PH1 is to be requested when either the detector D1 or the detector D4 or the key T2 are actuated. In accordance with FIG. 4, the program part PT1 corresponds to the phase PH1, actuation of the detectors D1 and D4 will result in the vehicle request signals FAN1 or FAN4, respectively, at the input of the programming field, while the actuation of the key T2 will result in the pedestrain request signal FUN2. Consequently, the condition for the request of program part 1 is the following:

$$APT\ 1 = FAN1 + FAN4 + FUN2.$$

The condition for the request of the remaining program parts cam be determined accordingly. For the phase PH2 (program part 2), the condition may, for example, be the following:

$$APT\ 2 = FAN\ 3 \cdot FAN\ 2$$

Since the phases PH2 and PH3 may only follow upon PH1, the request condition is expanded by additional linkage with the running program part and will then be:

$$APT\ 2 = LPT\ 1 \cdot FAN\ 3 \cdot FAN\ 2$$

and, in accordance with FIG. 4, program part 11, the request condition for the phase 5 may then be the following:

$$APT\ 11 = FAN\ 5 + FAN\ 6 + FUN\ 1 \cdot LPT\ 12 + LPT\ 13).$$

In this manner, all desired request conditions for the individual parts may be determined by appropriate wiring. As previously mentioned, it is also possible to consider additional external conditions such as external demands of superior control devices, in the same manner. In FIG. 5, for example, the abovementioned linkage for requesting program part AP2 is illustrated, in which the signals FAN2, FAN3, and LPT1 are linked by means of the logic elements to form an output signal APT2.

Figure 6:
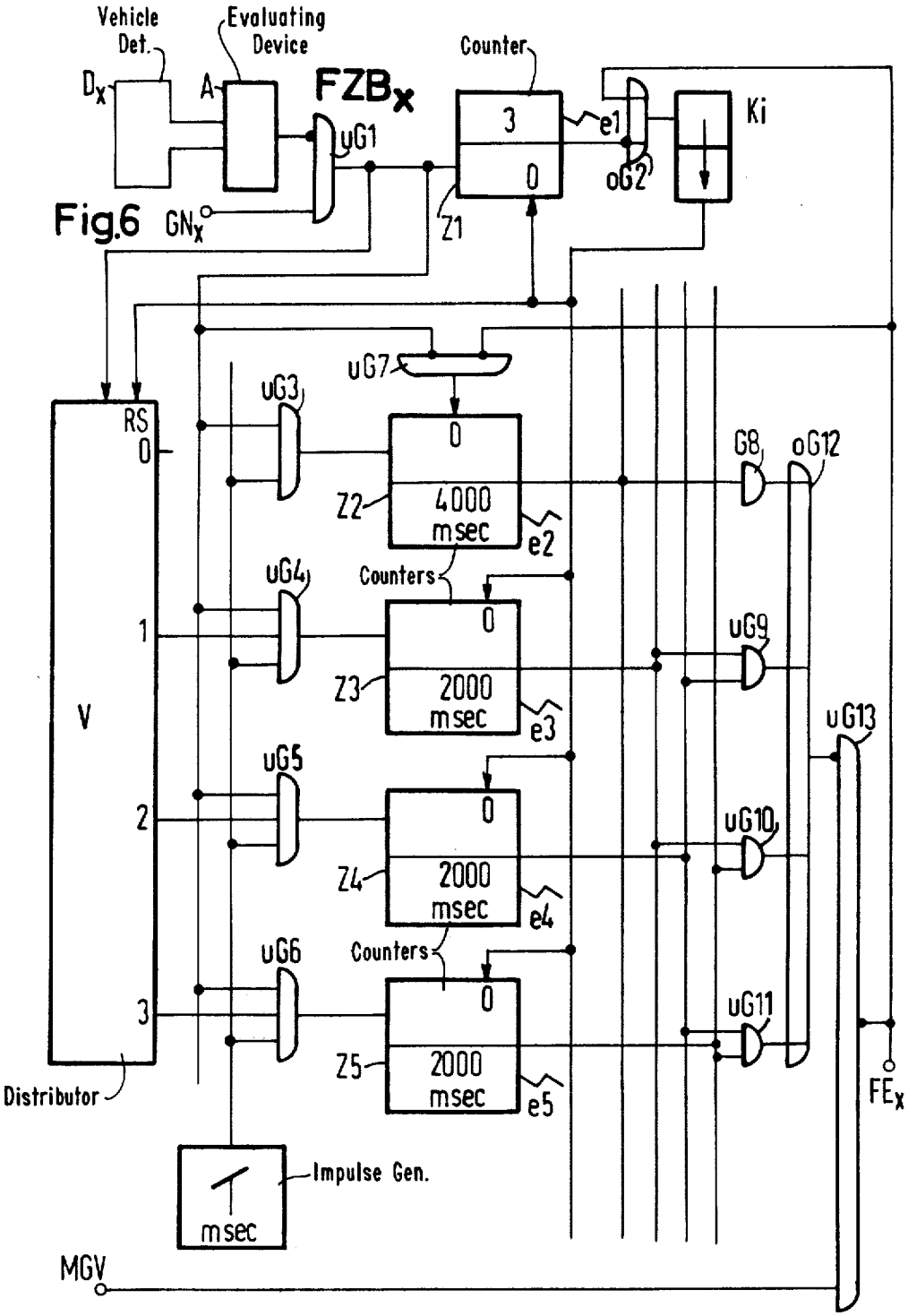
FIG. 6 illustrates a traffic time component in accordance with the invention.

The traffic time component $FZB_x$ illustrated in FIG. 6 is a detailed diagram of any one of the components FZB1 . . . 6 in FIG. 3a. In contrast with the previously described known methods of dimensioning the green light duration, operation of component $FZB_x$ requires either that one time interval exceeds the first relatively long time-limiting theoretical value or at least two time intervals both exceed a shorter second time limiting theoretical value.

The vehicle detector $D_x$ indicates, over an evaluating device A, the presence or absence of a vehicle, and in the event of a vehicle interval, it emits a "1" to the AND gate uG1 over an inverted input. The other input $GN_x$ of AND gate uG1 is connected to one of the associated signal groups SgA1 to SgA6 and will always receive a "1" when the associated signal group is green. Thus throuh each time interval an impulse is delivered to the counter Z1 and the distributor V both being thereby correspondingly counted forward. The counter Z1 is set for three impulses as hereinafter explained, by suitable setting means e1. The AND gates uG4 to uG6 are connected to the outputs 1 to 3 of the distributor V.

Thus, for the duration of each time interval, the AND gate uG3 and one of the AND gates uG4 to uG6 are conductive and impulse generator T connected to each gate can transmit impulses of advance one millisecond in length to one of the counters Z2 to Z5. The generator T will transmit pulses to one of the counters Z2 through Z5 only as long as an enabling pulse from the output of the gate uG1 is present at the respective AND gate preceding a particular counter. The number of one millisecond pulses thus reaching one of the counters Z2 to Z5 is determined by the duty time of the output pulse of gates uG1 which in turn corresponds to the duration of the time gap which has been detected between two successive vehicles. The counters are selectively set by respective adjusting means e2 to e5 for the first theoretical time limit value of 4000 milliseconds, for example, and/or the second theoretical time limit value of 2000 milliseconds. After each has reached its corresponding set threshold value, the counters Z2 to Z5 deliver a "1" value, but it should initially be assumed that none of the time intervals will reach a threshold value of the counters Z2 to Z5. Upon the occurrence of a third time interval, as measured by the counter Z1, the flipflop stage Ki which until that occurrence was, over the OR gate oG2, maintained in operating condition is flipped back into its rest position and thereby the counter Z1 and Z3 to Z5 and the distributor V are returned to their zero postion. The counter Z2 already is returned to its zero position over the AND gate uG7, in each case at the end of a time interval signified by the termination of the duty cycle of the pulse at the output of gate uG1. Each counter Z3 through Z5 thus maintains a positive output until reset by the flip-flop Ki.

If a single time interval represented by the duration of the pulse output of uG1 exceeds the first theoretical time limit value, a disconnect order is issued over the gate G8, the OR gate oG12 and the AND gate uG13 to the output $FE_x$, which, in FIG. 3*a*, arrives at the AND gate AN23 and terminates the green light period. If, however, none of the time intervals reaches the first theoretical time limit value, but at least two intervals reach the second theoretical time limit value, for example the counters Z3 and Z5, a disconnect order is issued over the AND gate uG10 and uG13 to the output $FE_x$ for the green light signal. A disconnect order at the outlet $FE_x$, however, also returns the counters Z3 to Z5 and the distributor V into their rest position. The disconnect order can however, be supplied to the output $FE_x$, only if a "1" exists from the program track MGV (marking green light time variable) according to FIG. 3*b* from the memory SRP.

The comparisons of the individual time intervals with the predetermined first and second theoretical limit time values may of course be obtained in a computer, for example a micro computer, by a corresponding sequential program.

Although I have described my invention by reference to particular illustrative embodiments, many changes and modifications of the invention may become apparent to those skilled in the art without departing from the spirit and scope of the invention. I therefore intened to include within the patent warranted hereon all such changes and modifications as may reasonably and properly be included within the scope of my contribution to the art.

I claim as my invention:

1. An apparatus for determining and prematurely terminating the green light duration in a programmed traffic-dependently controllable street traffic system utilizing measured time intervals, between successive vehicles comprising means, including a vehicle detector, for deriving signals representing actual time values of intervals between successive vehicles of a traffic flow during the duration of a green light signal, first comparing means to which said actual time values are supplied for comparing said actual time values with a first theoretical time limit value, a first OR gate having a first input to which said first comparing means is connected whereby, upon an actual time value reaching said first theoretical value, a disconnect order for termination of the green light duration appears at the output of said first OR gate, second comparing means to which successive actual time values are supplied for comparing the actual time values of a predetermined number of successive intervals with a second theoretical time value, said second comparing means having a plurality of outputs equal to said predetermined number at which a signal appears when a respective one of said intervals exceeds said second theoretical time value, and an AND gate means connecting said outputs of second comparing means to said first OR gate, whereby upon any two actual time values each exceeding said second theoretical time value said AND gate means is enabled and a disconnect order for the termination of the green light duration likewise appears at the output of said first OR gate.

2. An apparatus according to claim 1, wherein a first AND gate is interposed between an output of said signal-deriving means and inputs to each of said first and second comparing means, said first AND gate having an input responsive to the actuation of said green light signal whereby said first and second comparing means are enabled only during a green light signal.

3. An apparatus according to claim 2, wherein said programmed traffic-dependently controllable street-traffic system operates through a sequence of programs which normally control green light duration, and wherein only a portion of said programs allow premature green light termination, further comprising a marking means for providing a signal whenever a program in said portion is operating, and a second AND gate connected to the output of said first OR gate and to said marking means whereby said disconnect order is transmitted through said second AND gate only when a program in said portion is operating.

4. The apparatus of claim 3 wherein said apparatus includes a clock pulse generator and wherein said first comparing means comprises:

a third AND gate having inputs respectively connected to the output of said clock pulse generator and to the ouput of said first AND gate;

a first counter having an advancing input connected to the output of said third AND gate, said first counter selectively settable to generate an output signal to said first OR gate as said first counter is advanced by said clock pulses during a green light signal when said first counter reaches a count representing said first theoretical time limit value; and a fourth AND gate having an output connected to a reset input of said first counter, said fourth AND gate having inputs respectively connected to the outputs of said first AND gate and said second AND gate to reset said first counter when a disconnect order occurs.

5. The apparatus of claim 4 wherein said first theoretical time limit value is 4,000 milliseconds and wherein said clock pulse generator generates a pulse every millisecond.

6. The apparatus of claim 2 wherein said apparatus includes a clock pulse generator and wherein said second comparing means comprises:

a second counter having an advancing input connected to the output of said first AND gate, said second counter having a plurality of sequential outputs at which a signal appears in sequence as the count of said second counter is advanced;

a three-input AND gate associated with each said sequential output, each three-input AND gate having a first input connected thereto, a second input connected to said clock pulse generator and a third input connected to the output of said first AND gate;

a third counter associated with each three-input AND gate having an advancing input connected to the output thereof, each third counter selectively settable to generate an output signal to said AND gate means as said third counters are advanced by said clock pulses during a green light signal when a third counter reaches a count representing said second theoretical time limit value, whereby upon any two of said third counters generating an output signal, said AND gate means is enabled; and a reset means to provide a reset signal to each third counter upon the occurrence of a disconnect order or the occurrence of a predetermined number of successive intervals without a disconnect order.

7. The apparatus of claim 6 wherein said second theoretical time limit value is 2,000 milliseconds and said clock pulse generator generates a pulse every millisecond.

8. The apparatus of claim 6 wherein said reset means comprises:

a fourth counter having an advancing input connected to the output of said first AND gate and generating an output signal upon attaining a count equal to said predetermined number of successive intervals;

a second OR gate having an inverted input connected to said fourth counter output and another input connected to the output of said second AND gate; and a flip-flop connected to the output of said second OR gate, said flip-flop having an output connected to respective reset inputs of each of said third and fourth counters, whereby said flip-flop is normally in a 0 state and flips to a 1 state to reset said counters upon either a disconnect order or said predetermined number of intervals occurring.

* * * * *